US012036602B2

(12) United States Patent
Comand

(10) Patent No.: US 12,036,602 B2
(45) Date of Patent: Jul. 16, 2024

(54) OSCILLATING TABLE AND ASSEMBLY METHOD THEREOF

(71) Applicant: DANIELI & C. OFFICINE MECCANICHE S.p.A., Buttrio (IT)

(72) Inventor: Daniele Comand, S. Maria di Lestizza (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 18/246,017

(22) PCT Filed: Sep. 23, 2021

(86) PCT No.: PCT/IB2021/058667
§ 371 (c)(1),
(2) Date: Mar. 20, 2023

(87) PCT Pub. No.: WO2022/064403
PCT Pub. Date: Mar. 31, 2022

(65) Prior Publication Data

US 2023/0372997 A1 Nov. 23, 2023

(30) Foreign Application Priority Data

Sep. 23, 2020 (IT) ..... 102020000022390

(51) Int. Cl.
*B22D 11/053* (2006.01)

(52) U.S. Cl.
CPC ..... *B22D 11/053* (2013.01)

(58) Field of Classification Search
CPC ..... B22D 11/053
See application file for complete search history.

(56) References Cited

U.S. PATENT DOCUMENTS 6,138,743 A * 10/2000 Zajber ..... B22D 11/053 164/478

FOREIGN PATENT DOCUMENTS

CN 101342582 A 1/2009
CN 101648259 A * 2/2010
(Continued)

OTHER PUBLICATIONS

Patent Cooperation Treaty, International Search Report and Written Opinion for International Application No. PCT/IB2021/058667, Dec. 21, 2021, 11 pages.

*Primary Examiner* — Kevin E Yoon
(74) *Attorney, Agent, or Firm* — Stetina Brunda Garred & Brucker

(57) ABSTRACT

An oscillating table comprising an oscillating structure, inserted in a fixed frame adapted to be fixed integrally to the ground, the oscillating structure being adapted to accommodate an ingot mold provided with a crystallizer, defining a casting direction X, and adapted to be guided in an oscillation by elastic means arranged transversally to the casting direction, at least one actuator, adapted to transmit pulses with an alternating orientation, upwards and downwards, to said oscillating structure, so as to cause an oscillation motion thereof, wherein said elastic means comprise pairs or elastic bars having two respective ends fixed to the fixed frame, and having a respective central portion constrained to the oscillating structure, wherein two first elastic bars are arranged parallel to each other, at a first side and at a second side of said fixed frame, respectively, said first side and said second side being parallel to each other and equally spaced apart from said casting direction X, (Continued)

wherein two second elastic bars are arranged parallel to each other, at said first side and said second side respectively, below the first elastic bars, wherein the first elastic bars are inclined by a first acute angle with respect to a horizontal plane, and wherein the second elastic bars are inclined by a second acute angle, different from said first acute angle, with respect to said horizontal plane.

19 Claims, 4 Drawing Sheets

(56) References Cited

FOREIGN PATENT DOCUMENTS

| | | | | | |
|---|---|---|---|---|---|
| CN | 202224616 | U | 5/2012 | | |
| WO | WO-2007096389 | A1 * | 8/2007 | ..... | B22D 11/053 |

* cited by examiner

OSCILLATING TABLE AND ASSEMBLY METHOD THEREOF

CROSS-REFERENCE TO RELATED APPLICATIONS

This application claims priority to PCT International Application No. PCT/IB2021/058667 filed on Sep. 23, 2021, which applications claims priority to Italian Patent Application No. 102020000022390 filed on Sep. 23, 2020, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention relates to an oscillating table, in particular a table used in plants for the production of billets, blooms, or other steel semi-finished products to allow the oscillation of the crystallizer inserted in an ingot mold in order to carry out the casting process.

The invention further relates to an assembly method of the oscillating table.

Background Art

The oscillating table is an element, known in the steelworks industry, which sets the ingot mold in oscillating motion, and thus the crystallizer contained therein, into which the casting takes place.

The repetitive motion of the oscillating table serves to prevent the skin of the product from sticking to the walls of the crystallizer. Said skin is formed due to the heat exchange between the liquid steel and the walls of the crystallizer which is externally cooled. The lubricating effect can also be increased by the introduction of lubricating powders, which are inserted between the skin of the product and the walls of the crystallizer.

The oscillating table is characterized by the presence of one or more actuators which impose a determined stroke on the movable structure or oscillating stand of the table, based on a periodic, generally sinusoidal, oscillation. The required stroke and oscillation will vary according to the casting speed, the cast material, and other operating parameters.

Another fundamental parameter for the correct casting of different products is the casting radius of the machine, which is defined in the initial designing step according to the combination of geometries and dimensions of the set of products that the machine will have to cast.

Once identified, the initial definition of the casting radius remains fixed and thus limits the configuration of the system. For the installers of continuous casting machines, this configuration normally requires dedicated engineering for each of the possible casting radii, and thus requires several assemblies, BoM (Bill of Materials), and master records, in addition to complicating the management of finished parts in stock and spare parts which could significantly increase the supply time of these materials to customers and increase costs.

Indeed, continuous casting machines, installed at different customers' premises, may have different casting radii, requiring the installer and maintenance personnel to equip themselves with a combination of components adapted to the various casting radius types, with complications and associated costs.

Therefore, the need is felt to develop an oscillating table and an assembly method thereof to overcome the above-mentioned drawbacks in order to simplify the work of installers and maintainers.

SUMMARY OF THE INVENTION

It is a purpose of the present invention to make an oscillating table for production plants of billets, blooms, or other steel semi-finished products, which allows a simple and quick initial configuration corresponding to a given casting radius within a range of different possible casting radii, using the same oscillating table that can be adapted during the first assembly step according to design requirements.

It is another purpose of the invention to make an assembly method of an oscillating table, which can be adapted to different casting radii, said method being more efficient and allowing to simplify the work of installers and maintainers.

Therefore, the present invention intends to achieve the objects discussed above by making an oscillating table comprising

- a support fixed frame, integrally fixed to the ground or supports, preferably made of metal, which are fixed to the ground in turn;
- an oscillating structure or stand, which can be inserted in said fixed frame and adapted to accommodate an ingot mold provided with a crystallizer defining a casting direction X;
- at least one actuator, adapted to transmit pulses with an alternating orientation, upwards and downwards, to the oscillating structure, so as to cause an oscillation motion thereof with respect to the fixed frame;
- elastic means, arranged transverse to the casting direction X and adapted to guide said oscillation motion of the oscillating structure;
  - wherein said elastic means comprise two first elastic bars and two second elastic bars, defining a respective axis, each having two respective ends fixed to the fixed frame, and having a respective central portion constrained to the oscillating structure,
  - wherein the first elastic bars are arranged parallel to each other, at a first side and at a second side of said fixed frame, respectively, said first side and said second side being parallel to each other and equally spaced apart from said casting direction X,
  - wherein the second elastic bars are arranged parallel to each other, respectively, at said first side and at said second side, below the first elastic bars,
  - wherein the first elastic bars are inclined by a first acute angle with respect to a horizontal plane,
  - wherein the second elastic bars are inclined by a second acute angle, different from said first acute angle, with respect to said horizontal plane, whereby two ideal intersection points between the axes of the first elastic bars and the corresponding axes of the second elastic bars define an ideal oscillation axis Y about which the oscillating structure can oscillate,
  - wherein each first elastic bar and each second elastic bar are housed within a respective hollow housing, defining a longitudinal axis parallel to the axis of the respective elastic bar contained therein;

wherein the two ends of each first elastic bar and each second elastic bar are fixed in a pretensioned manner within corresponding ends of the respective hollow housing;

wherein the two ends of each hollow housing are removably fixed to the support fixed frame;

and wherein a central part of each hollow housing has at least one through-hole, transverse to the longitudinal axis of the hollow housing, at the respective central portion to easily allow either constraining said central portion to the oscillating structure or releasing said central portion from the oscillating structure.

Another aspect of the invention relates to an assembly method of the aforesaid oscillating table in which it is provided that each first elastic bar and each second elastic bar is housed within a respective hollow housing, the two ends of each first elastic bar and each second elastic bar being fixed in a pretensioned manner within corresponding ends of the respective hollow housing;

the method comprising the following steps:

a) inserting the oscillating structure at least partially into the fixed frame;

b) inserting the central portion of each first elastic bar and each second elastic bar onto the oscillating structure, using the through-hole of the central part of the respective hollow housing;

c) adjusting the first acute angle of inclination of the first elastic bars and the second acute angle of inclination of the second elastic bars;

d) removably fixing the two ends of each hollow housing to the fixed frame;

e) fixing the central portion of each first elastic bar and each second elastic bar to the oscillating structure.

In particular, if maintenance of the oscillating table is necessary, it is sufficient to release the central portion of the elastic bar, or of the elastic bars, from the oscillating structure and remove the two ends of the hollow housing containing the elastic bar from the support fixed frame for possible replacement or other maintenance operation.

Then, after maintenance, the first acute angle of inclination of the first elastic bars and the second acute angle of inclination of the second elastic bars are adjusted again, and finally the ends of the hollow housing of the first elastic bars and the ends of the hollow housing of the second elastic bars are fixed again to the fixed frame, and the central portion of each first elastic bar and each second elastic bar is fixed to the oscillating structure. Therefore, no dedicated construction parts are required for each casting radius.

Therefore, the central portion of the first and second elastic bars is maintained always at a respective portion of the oscillating structure, preferably at a respective locking device, only the inclination of said elastic bars being adjusted.

The solution of the invention which provides using pretensioned elastic bars or pretensioned tie-rods within respective hollow housings, having ends fixable in a removable manner to the support fixed frame, has the following advantages:

the same oscillating table can be adapted to different casting radii, simply by adjusting the orientation/inclination of the hollow housings or boxes, containing the respective pretensioned tie-rod, and fixing their ends in preset areas of the fixed frame, shortening the preparation time of the casting unit;

the possibility of limiting the types of spare parts in stock for these components to only one type;

easy to assemble, with no need for subsequent adjustment, as the box contains the already pretensioned tie-rod, and thus directly ready for use. This saves time for maintenance or replacement of the bars and offers greater on-site accuracy because the pretensioning can be conveniently performed in the workshop and does not have to be done near the oscillating table.

The ends of the hollow housing, containing the respective pretensioned elastic bar, can be removably fixed in fixed positions on the support fixed frame; this allows for quick assembly, even directly in the casting area, without the need for alignment in the tooling workshop.

In particular, predetermined holes can be provided on the fixed frame for fixing the ends of the hollow housings, said predetermined holes corresponding to different inclinations of the first and second elastic bars, and thus to different casting radii.

The fact that the hollow housings of the first and second elastic bars all have the same length, as well as the pretensioned elastic bars inside said hollow housings, makes it easy to arrange their fixing to the fixed frame.

Other advantages of the oscillating table of the invention are:

a better surface quality of the cast product;

a reduction in the possibility of break-out;

a reduction in maintenance operations;

a reduction of downtime in case of maintenance.

The dependent claims describe preferred embodiments of the invention.

DESCRIPTION OF THE FIGURES

Further features and advantages of the present invention will be more apparent in light of the detailed description of preferred but not exclusive embodiments of an oscillating table illustrated by way of non-limiting example, with reference to the accompanying drawings, in which.

The same reference numbers in the figures identify the same elements or components.

DETAILED DESCRIPTION OF EXEMPLARY EMBODIMENTS OF THE INVENTION

Figure 1:
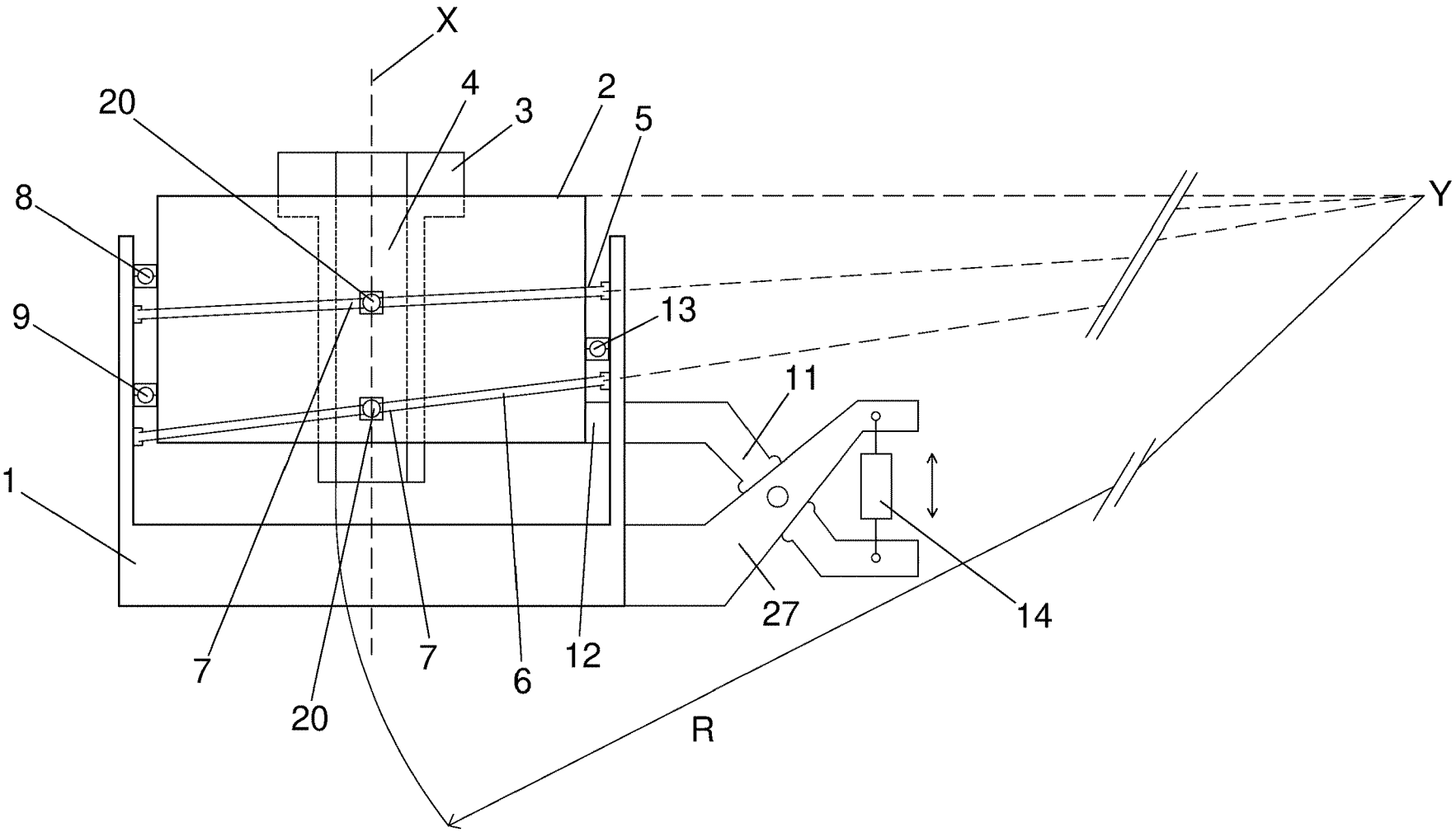
FIG. 1 is a first diagrammatic side view of an oscillating table according to the invention.

The figures show an oscillating table, object of the present invention, comprising:

a support fixed frame 1, integrally fixed to the ground or to supports, preferably made of metal, which are in turn fixed to the ground;

an oscillating structure or stand 2, called oscillating table stand, inserted in the support fixed frame 1 and adapted to accommodate an ingot mold 3 provided with a crystallizer 4 defining a casting direction X;

at least one actuator 14, adapted to transmit pulses with an alternating orientation, upwards and downwards, to the oscillating structure 2, so as to cause an oscillation motion thereof with respect to the support fixed frame 1;

elastic means, arranged transversely to the casting direction X and adapted to guide the oscillation motion of the oscillating structure 2.

Said elastic means comprise, in all embodiments of the invention, two first elastic bars 5, 5' and two second elastic bars 6, 6', defining a respective axis, having two respective ends fixed indirectly to the support fixed frame 1, and having a respective central portion 7 constrained to the oscillating structure 2.

The two first elastic bars 5, 5' are arranged parallel to each other, being positioned at a first side and at a second side of said support fixed frame 1, respectively, said first side and said second side being parallel to each other and equally spaced apart from said casting direction X. Also, the second elastic bars 6, 6' are arranged parallel to each other, being respectively positioned at said first side and at said second side, below the first elastic bars 5, 5' (FIG. 2).

Advantageously, the first elastic bars 5, 5' are inclined, in an adjustable manner, by a first acute angle with respect to a horizontal plane, while the second elastic bars 6, 6' are inclined, in an adjustable manner, by a second acute angle, different from said first acute angle, with respect to said horizontal plane, whereby the two ideal intersection points between the axes of the first elastic bars and the corresponding axes of the underlying second elastic bars define an ideal oscillation axis Y about which the oscillating structure 2 can oscillate (FIG. 1). A casting radius R is also shown in FIG. 1.

Figure 2:
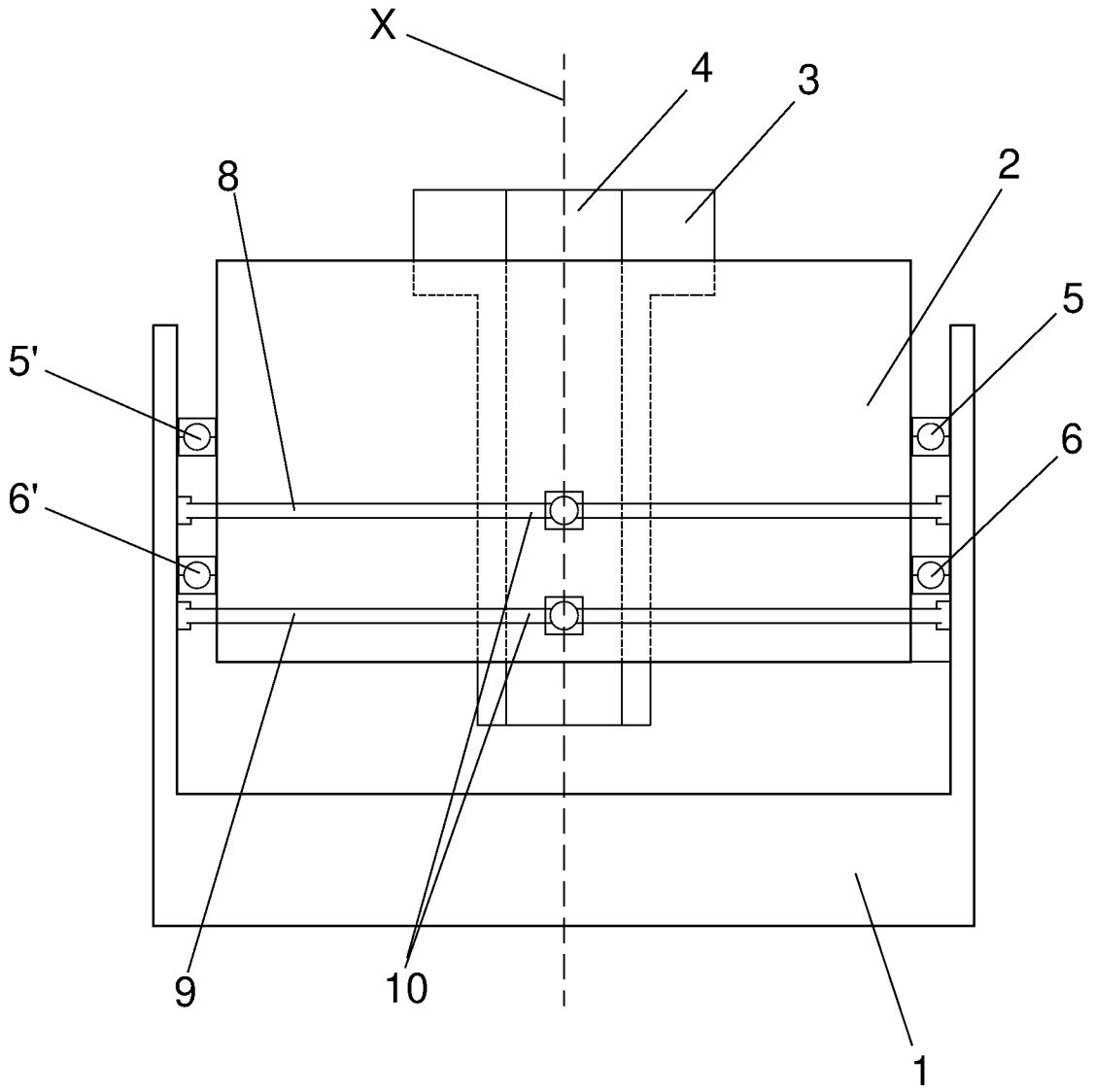
FIG. 2 is a second diagrammatic side view of the oscillating table in FIG. 1.

Preferably, both the first elastic bars 5, 5' and the second elastic bars 6, 6' are arranged symmetrically with respect to a plane containing the casting direction X (FIG. 2).

In a first variant, the first acute angle of inclination of the first elastic bars 5, 5' and the second acute angle of inclination of the second elastic bars 6, 6' have the same sign with respect to the horizontal plane containing the ideal oscillation axis Y (FIG. 1).

Instead, in a second variant (not shown), the first acute angle and the second acute angle are of opposite sign with respect to the horizontal plane containing the ideal oscillation axis Y.

In an embodiment of the oscillating table of the invention, the oscillating structure 2 is provided with a plurality of locking devices 20, one locking device 20 for each of the first elastic bars 5, 5' and the second elastic bars 6, 6'.

Preferably, each locking device 20 comprises, preferably consists of (FIG. 3):

- a first part 21, proximal to the oscillating structure 2, on which a central portion 7 (not shown in FIG. 3) of a respective first elastic bar 5, 5' or second elastic bar 6, 6' is initially inserted during the assembly step of the table;
- and a second part 22, distal from the oscillating structure 2 and superimposed on the first part 21 and the respective central portion 7 to lock the central portion 7 of the elastic bar and/or said first part 21 in position, after having adjusted the inclination of the elastic bar.

In a first variant of the locking device 20, the first part 21, e.g. in the form of a protruding pin, is fixed to the oscillating structure 2 so that said first part can rotate about its own axis Z. The end face of the pin, distal from the oscillating structure 2, is provided with a groove 23 in which the central portion 7 of the respective elastic bar 5, 5', 6, 6' can be fitted. The rotation, by an operator, of the protruding pin and of the elastic bar fitted therein, allows adjusting the inclination angle of the elastic bar. Once the acute angle of inclination of the elastic bar has been adjusted, the second part 22 of the locking device, e.g., in the form of a fixing flange, is applied to the first part 21, locking in position both the central portion 7, and thus the elastic bar, and the first part 21 of the device. The second part 22 can be fixed to the first part 21 of the locking device 20 and to the oscillating structure 2 by means of a plurality of fixing means, such as screws, which cross the first part 21 completely.

Figure 3:
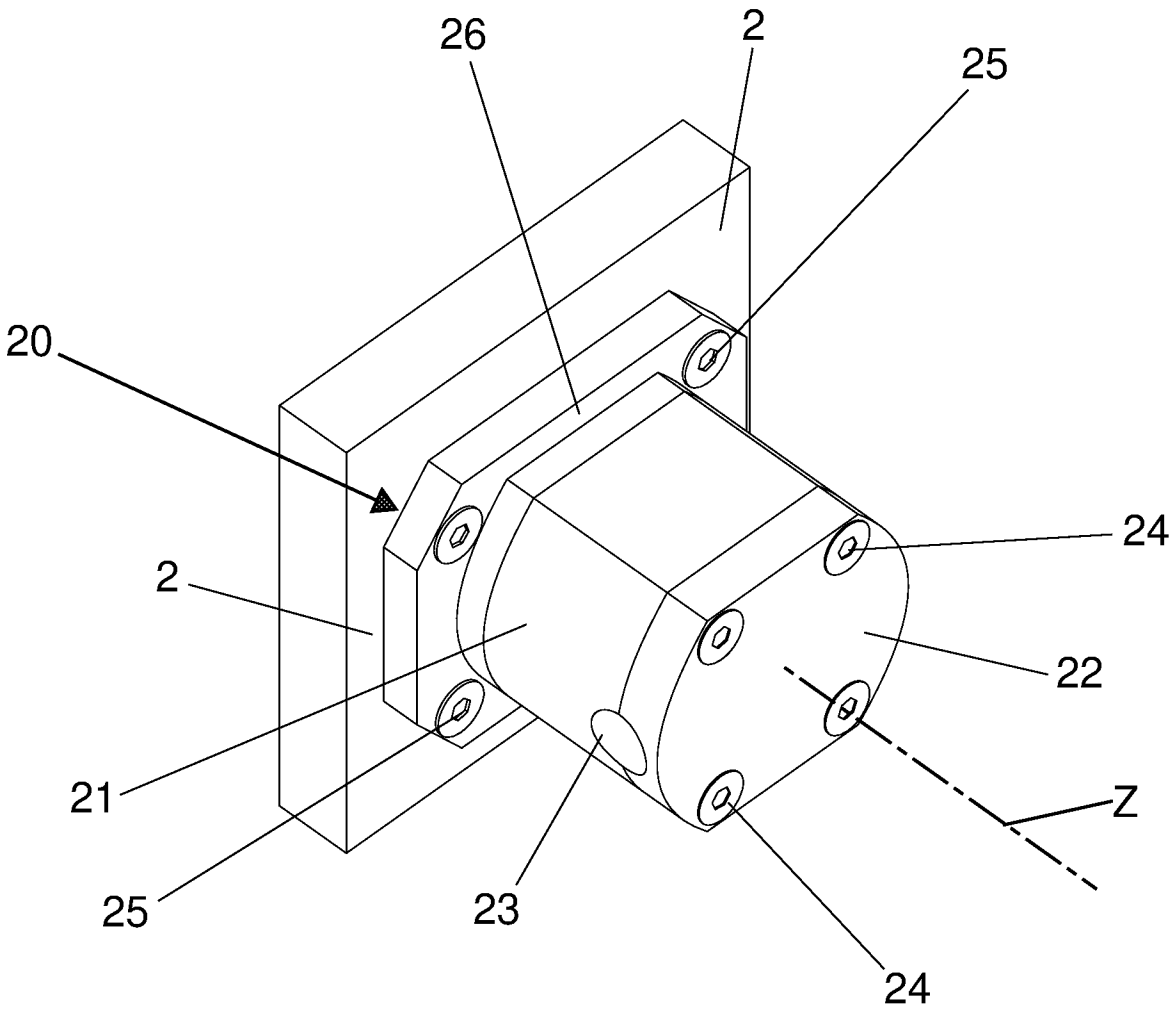
FIG. 3 is a perspective view of a component of the oscillating table of the invention.

Alternatively, as shown in FIG. 3, the second part 22 can be fixed to the first part 21 by means of a plurality of first fixing means, such as screws 24, while the first part 21 can be fixed to the oscillating structure 2 by means of a plurality of second fixing means, such as screws 25. Preferably, a fixing flange 26 is provided which constitutes a base of the first part 21, the latter being in the form of a pin protruding from said base. The screws 25, in this case, completely cross the fixing flange 26.

In a second variant of the locking device 20, the first part 21, e.g., in the form of a protruding pin, is integrally fixed to the oscillating structure 2. The end face of the pin, distal from the oscillating structure 2, is provided with a groove 23 in which the central portion 7 of the respective elastic bar 5, 5', 6, 6' can be inserted. A clearance is provided between the groove 23 and said central portion 7 which allows the operator to adjust the angle of inclination of the elastic bar. Once the acute angle of inclination of the elastic bar has been adjusted, and the clearance has possibly been eliminated by inserting at least one shim, the second part 22 of the locking device, e.g., in the form of a fixing flange, is applied to the first part 21, locking in position the central portion 7, and thus the elastic bar. As shown in FIG. 3, the second part 22 can be fixed to the first part 21 by means of a plurality of first fixing means, such as screws 24, while the first part 21 can be fixed to the oscillating structure 2 by means of a plurality of second fixing means, such as screws 25. Preferably, a fixing flange 26 is provided which constitutes a base of the first part 21, the latter being in the form of a pin protruding from said base. The screws 25, in this case, completely cross the fixing flange 26.

Advantageously, in all the embodiments of the invention, each first elastic bar 5, 5' and each second elastic bar 6, 6' are housed within a respective hollow housing, or longitudinal shell or box 30, defining a longitudinal axis either coinciding with or parallel to the axis of the respective elastic bar contained therein. In other words, each elastic bar 5, 5', 6, 6' is housed in a respective hollow housing 30. Therefore, there are as many hollow housings 30 as there are elastic bars 5, 5', 6, 6'.

The two ends 31, 32 of each first and second elastic bar are fixed and advantageously pretensioned within corresponding ends 33, 34 of the respective hollow housing 30.

The elastic bar within the respective hollow housing 30 is previously pretensioned in the workshop according to known techniques, e.g., by locking the tie-rod in the central stretch and then tensioning the two ends one by one using torque wrenches to the desired values.

The two ends 33, 34 of each hollow housing 30 are removably fixed to the support fixed frame 1, e.g., by means of a series of screw 35.

Therefore, the elastic bar is indirectly fixed to the support fixed frame 1.

The central portion of the hollow housing 30 has at least one through-hole 36, preferably only one through-hole 36, transverse to the longitudinal axis of the hollow housing, at which the central portion 7 of the respective elastic bar 5, 5', 6, 6' is arranged, which can thus be easily constrained to the oscillating structure 2, e.g., in the manners described above.

Such a through-hole 36 is, for example, suitable for being crossed by a respective fixing device 20, such as those described above.

Regarding the table oscillation actuation system, an embodiment provides a body 11 hinged to the support fixed frame 1, e.g., by one or two pins, and adapted to oscillate about said one or two pins by means of at least one actuator 14, preferably a single actuator. The oscillating structure 2 rests on said body 11, thus being able to oscillate together with the body 11. The body 11 can be hinged directly on the support fixed frame 1 or indirectly on one or two protrusions 27 of said support fixed frame 1, as shown in FIG. 1.

Preferably, the body 11 is provided with two arms 12 arranged at said first side and said second side, respectively, of the support fixed frame 1, and the oscillating structure 2 rests on said two arms 12.

In an embodiment of the table of the invention, both the support fixed frame 1 and the oscillating structure 2, inserted therein, have four side walls, thus four sides, substantially perpendicular to the ground. In particular, the four side walls of the support fixed frame 1 have at least one large opening so that the side walls of the oscillating structure 2 are accessible. Therefore, the locking devices 20 described above are accessible to the operator through these openings.

In a variant of the table, two third elastic bars 8, 9 are provided having both ends fixed to the support fixed frame 1 and a central portion 10 constrained to the oscillating structure 2.

These two third elastic bars 8, 9 are arranged parallel to each other and transverse to the first elastic bars 5, 5' and to the second elastic bars 6, 6', and positioned at a third side of the support fixed frame 1, which is transverse to said first side and said second side.

The two third elastic bars 8, 9 are preferably arranged horizontally.

The function of said two third elastic bars 8, 9 is to contain the lateral skidding of the table during the oscillation.

The body 11, on which the oscillating structure 2 rests, can be hinged to the support fixed frame 1, either directly or indirectly, at a fourth side thereof, opposite said third side.

At least one fourth elastic bar 13 can also be provided, preferably only one fourth elastic bar, having both ends fixed to the support fixed frame 1 and a central portion thereof constrained to the oscillating structure 2.

This fourth elastic bar 13 is arranged parallel to the third elastic bars 8, 9 at the fourth side of the support fixed frame 1. Therefore, said fourth elastic bar 13 is also preferably arranged horizontally.

The function of said fourth elastic bar 13 is again to contain the lateral skidding of the table during the oscillation.

Preferably, the fourth elastic bar 13 can be arranged either above or below the arms 12 of the body 11, or simply either above or below the body 11, at one end of the second elastic bars 6, 6'.

Preferably, the central portions of the two third elastic bars 8, 9 and of the fourth elastic bar 13 can also be constrained to the oscillating structure 2 by means of a respective locking device 20, such as that described above.

Figure 4:
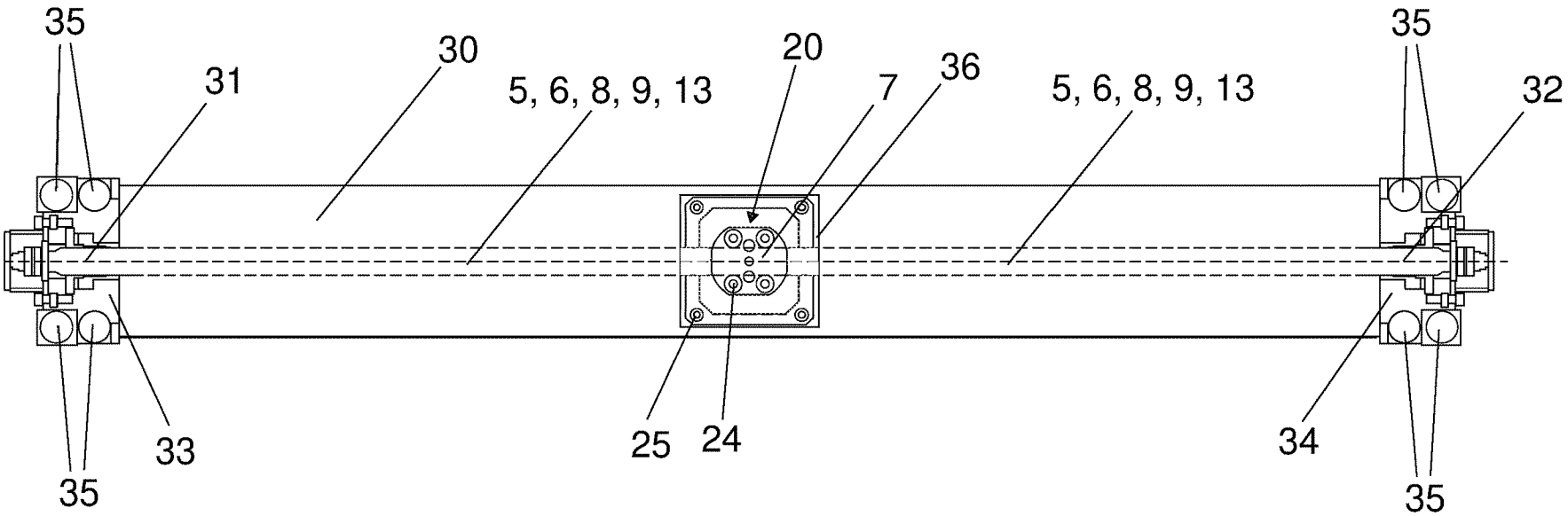
FIG. 4 is a side view, partially sectioned at the ends, of a further component of the oscillating table of the invention.

The aforementioned hollow housing 30 (FIG. 4) can also be provided for the two third elastic bars 8, 9 and the fourth elastic bar 13.

In this case, the third elastic bars 8, 9 are housed within a respective hollow housing 30 defining a longitudinal axis parallel to the axis of the respective third elastic bar contained therein. The two ends 31, 32 of each third elastic bar 8, 9 are fixed and pretensioned within corresponding ends 33, 34 of the respective hollow housing 30, whereas the two ends 33, 34 of each hollow housing 30 are removably fixed to the support fixed frame 1. The central part of each hollow housing 30 also has at least one through-hole 36, preferably a single through-hole, transverse to the longitudinal axis of the hollow housing, at a central portion 10 of the respective third elastic bar allowing to either constrain or release said central portion 10 with respect to the oscillating structure 2.

Similarly, also the fourth elastic bar 13 is housed within a corresponding hollow housing 30 defining a longitudinal axis parallel to the axis of the fourth elastic bar. The two ends 31, 32 of the fourth elastic bar 13 are fixed and pretensioned within corresponding ends 33, 34 of the hollow housing 30, while the two ends 33, 34 of the hollow housing 30 are removably fixed to the support fixed frame 1. The central part of the hollow housing 30 also has at least one through-hole 36, preferably a single through-hole, transverse to the longitudinal axis of the hollow housing, at the central portion of the fourth elastic bar 13 to allow either constraining or releasing said central portion to or from the oscillating structure 2.

An assembly method of an oscillating table according to the invention is described below, wherein it is provided that each first elastic bar 5, 5' and each second elastic bar 6, 6' are housed within a respective hollow housing 30, the two ends 31, 32 of each first elastic bar 5, 5' and each second elastic bar 6, 6' being fixed and pretensioned within corresponding ends 33, 34 of the respective hollow housing 30. Such a method comprises the following steps:

a) inserting the oscillating structure 2 at least partially into the support fixed frame 1;

b) inserting the central portion 7 of each first elastic bar 5, 5' and each second elastic bar 6, 6' onto the oscillating structure 2, said central portion 7 being accessible thanks to the presence of the through-hole 36 of the central part of the respective hollow housing 30;

c) adjusting the first acute angle of inclination of the first elastic bars 5, 5' and the second acute angle of inclination of the second elastic bars 6, 6';

d) indirectly fixing the ends of the first elastic bars 5, 5' and the ends of the second elastic bars 6, 6' to the support fixed frame 1 by fixing the two ends 33, 34 of each hollow housing 30 in a removable manner to the fixed frame 1;

e) fixing the central portion 7 of each first elastic bar 5, 5' and each second elastic bar 6, 6' to the oscillating structure 2, again by using the through-hole 36.

After step e), the insertion of the ingot mold 3, equipped with the crystallizer 4, into the oscillating structure 2, can be provided.

The steps (d) and (e) can be reversed.

In step d), the ends 33, 34 of the hollow housings 30 of the first elastic bars 5, 5' and of the second elastic bars 6, 6' can be fixed to the support fixed frame 1 with any reversible fixing means, i.e., adapted to allow said ends 33, 34 to be loosened, when necessary, from the support fixed frame 1 and fixed to said support fixed frame 1 again.

In a first variant of the assembly method, it is provided that in step b), the central portion 7 of each first elastic bar 5, 5' and each second elastic bar 6, 6' is fitted in a first part 21, e.g., in the form of a protruding pin, of a respective fixing device 20, said first part 21 being proximal and fixed to the oscillating structure 2 so as to rotate about its own axis transverse to the oscillating structure 2;

in step c) the first acute angle and the second acute angle are adjusted by rotating the respective first part 21 about the axis thereof;

in step e) the fixing of the respective central portion 7 to the oscillating structure 2 occurs by applying a second part 22, e.g., in the form of a fixing flange, of the locking device 20 onto the first part 21.

In step b), for example, the central portion 7 of each first elastic bar 5, 5' and each second elastic bar 6, 6' is fitted in a groove 23 of said first part 21 of the respective locking device 20.

In particular, in step b) the central portion 7 of each first elastic bar 5, 5' and each second elastic bar 6, 6' is fitted in the first part 21 of the fixing device 20 thanks to the presence of the through-hole 36 provided in the central part of the hollow housing 30. The first acute angle and the second acute angle are adjusted by rotating the respective first part 21 about its own axis, because the operator can rotate the first part 21 through said through-hole 36. The application of the second part 22 on the first part 21 to fix the respective central portion 7 to the oscillating structure 2 is also performed through the through-hole 36 of the hollow housing 30.

Instead, in a second variant of the assembly method, it is provided that in step b) the central portion 7 of each first elastic bar 5, 5' and each second elastic bar 6, 6' is inserted into a groove 23 of a first part 21, e.g., in the form of a protruding pin, of a respective fixing device 20, said first part 21 being proximal to and integrally fixed to the oscillating structure 2;

in step c) the first acute angle and the second acute angle are adjusted by fixing the respective central portion 7 within the corresponding groove 23, e.g., by inserting at least one shim to eliminate the clearance between said groove 23 and the central portion 7;

in step e) the fixing of the respective central portion 7 to the oscillating structure 2 occurs by applying a second part 22, e.g., in the form of a fixing flange, of the locking device 20 onto the first part 21.

In particular, in step b) the central portion 7 of each first elastic bar 5, 5' and each second elastic bar 6, 6' is inserted in the first part 21 of the fixing device 20 by virtue of the presence of the through-hole 36 provided in the central part of the hollow housing 30. The first acute angle and the second acute angle are adjusted by fixing the respective central portion 7 within the corresponding groove 23, e.g., by inserting, using said through-hole 36, at least one shim to eliminate the clearance between said groove 23 and the central portion 7. The application of the second part 22 on the first part 21 to fix the respective central portion 7 to the oscillating structure 2 is also performed through the through-hole 36 of the hollow housing 30.

Preferably, the following is also provided:

inserting a central portion 10 of the two third elastic bars 8, 9 on the oscillating structure 2, arranging said third elastic bars parallel to each other and transverse to the first elastic bars 5, 5' and the second elastic bars 6, 6', at a third side of the support fixed frame 1 which is transverse to said first side and said second side;

fixing both ends of the third elastic bars 8, 9 to the support fixed frame 1, either directly or indirectly if the hollow housing 30 is also provided for these elastic bars 8, 9;

fixing the central portion 10 of each third elastic bar 8, 9 to the oscillating structure 2;

and optionally inserting a central portion of at least one fourth elastic bar 13 onto the oscillating structure 2, arranging said fourth elastic bar parallel to the third elastic bars 8, 9 at a fourth side of the support fixed frame 1, opposite to said third side;

fixing both ends of said fourth elastic bar 13 to the support fixed frame, either directly or indirectly if the hollow housing 30 is also provided for the elastic bar 13;

fixing the central portion of said fourth elastic bar 13 to the oscillating structure 2.

Advantageously, with the solution of the invention, if maintenance of the oscillating table is necessary, it is sufficient to release the central portion 7 of each elastic bar 5, 5, 6, 6' from the oscillating structure 2 and remove the two ends 33, 34 of the hollow housing 30 containing the elastic bar from the support fixed frame 1 for possible replacement or other maintenance operation.

Then, after maintenance, the first acute angle of inclination of the first elastic bars 5, 5' and the second acute angle of inclination of the second elastic bars 6, 6' are adjusted again, and finally the ends 33, 34 of the hollow housings 30 of the first elastic bars 5, 5' and the ends 33, 34 of the hollow housings 30 of the second elastic bars 6, 6' are fixed again to the support fixed frame 1, and the central portion 7 of each first elastic bar 5, 5' and each second elastic bar 6, 6' is fixed to the oscillating structure 2.

Therefore, the central portion 7 of the first and second elastic bars is maintained at a respective portion of the oscillating structure 2, preferably at a respective locking device 20, only the inclination of said elastic bars 5, 5', 6, 6' being adjusted.

Similarly, it is possible to proceed with the possible third elastic bars 8, 9, and the possible fourth elastic bar 13, although no angle of inclination with respect to the horizontal has to be adjusted for these elastic bars.

The invention claimed is:

1. An oscillating table comprising a support fixed frame, adapted to be fixed integrally to the ground or to supports fixed to the ground;

an oscillating structure, insertable into said fixed frame and adapted to accommodate an ingot mold provided with a crystallizer defining a casting direction X;

at least one actuator adapted to transmit pulses in an alternating direction, upwards and downwards, to the oscillating structure, so as to cause an oscillation motion thereof with respect to the fixed frame;

elastic means, arranged transversely to the casting direction X and adapted to guide said oscillation motion of the oscillating structure;

wherein said elastic means comprise two first elastic bars and two second elastic bars, each defining a respective axis, having two respective ends fixed to the fixed frame, and having a respective central portion constrained to the oscillating structure, wherein the first elastic bars are arranged parallel to each other, at a first side and at a second side of said fixed frame, respectively, said first side and said second side being parallel to each other and equally spaced apart from said casting direction X, wherein the second elastic bars are arranged parallel to each other, respectively at said first side and said second side, below the first elastic bars, wherein the first elastic bars are inclined by a first acute angle with respect to a horizontal plane, and wherein the second elastic bars are inclined by a second acute angle, different from said first acute angle, with respect to said horizontal plane, whereby two ideal intersection points between the axes of the first elastic bars and the corresponding axes of the underlying second elastic bars define an ideal oscillation axis about which the oscillating structure can oscillate;

wherein each first elastic bar and each second elastic bar are housed inside a respective hollow housing defining a longitudinal axis parallel to the axis of the respective elastic bar contained therein;

wherein the two ends of each first elastic bar and each second elastic bar are fixed and pretensioned inside corresponding ends of the respective hollow housing;

wherein the two ends of each hollow housing are removably fixed to the support fixed frame;

and wherein a central part of each hollow housing has at least one through-hole, transversal to the longitudinal axis of the hollow housing, at the respective central portion to allow to either constraining or releasing said central portion with respect to the oscillating structure.

2. The oscillating table according to claim 1, wherein said first acute angle and said second acute angle are of the same sign or of opposite sign with respect to the horizontal plane containing said ideal oscillation axis.

3. The oscillating table according to claim 1, wherein the oscillating structure is provided with a plurality of locking devices, one for each of the first elastic bars and second elastic bars, each locking device having a first part, on which a respective central portion is inserted, and a second part overlapping the first part and the respective central portion to lock said central portion and/or said first part in position after an adjustment of the inclination of the respective first or second elastic bar.

4. The oscillating table according to claim 1, wherein both the first elastic bars and the second elastic bars are arranged symmetrically to a plane containing the casting direction X.

5. The oscillating table according to claim 1, wherein there is provided a body, hinged to said fixed frame; wherein the oscillating structure is resting on said body; and wherein said at least one actuator is adapted to cause said body to oscillate.

6. The oscillating table according to claim 5, wherein the body is provided with two arms, a first arm being arranged at said first side and a second arm being arranged at said second side; and wherein the oscillating structure is resting on said two arms.

7. The oscillating table according to claim 1, wherein there are provided two third elastic bars, having both ends fixed to the fixed frame and a central portion constrained to the oscillating structure, said two third elastic bars being arranged parallel to each other and transverse to the first elastic bars and the second elastic bars, and positioned at a third side of the fixed frame, which is transverse to said first side and said second side.

8. The oscillating table according to claim 7, wherein there is provided a body, hinged to said fixed frame at a fourth side thereof opposite to said third side; wherein the oscillating structure is resting on said body; and wherein said at least one actuator is adapted to cause said body to oscillate.

9. The oscillating table according to claim 7, wherein there is provided at least one fourth elastic bar, preferably only one fourth elastic bar, having both ends fixed to the fixed frame and a central portion thereof constrained to the oscillating structure, said at least one fourth elastic bar being arranged parallel to the third elastic bars at a fourth side of the fixed frame, opposite to said third side.

10. The table according to claim 9, wherein the body is provided with two arms, a first arm being arranged at said first side and a second arm being arranged at said second side; wherein the oscillating structure is resting on said two arms; and wherein said at least one fourth elastic bar is arranged above or below the arms of the body, preferably at the second elastic bars.

11. The oscillating table according to claim 9, wherein said at least one fourth elastic bar is housed within a hollow housing defining a longitudinal axis parallel to the axis of the fourth elastic bar;

wherein the two ends of said at least one fourth elastic bar are fixed and pretensioned within corresponding ends of the hollow housing;

wherein the two ends of the hollow housing are removably fixed to the support fixed frame;

and wherein a central part of the hollow housing has at least one through-hole, transverse to the longitudinal axis of the hollow housing, at the central portion of the fourth elastic bar to allow either constraining or releasing said central portion to or from the oscillating structure.

12. The oscillating table according to claim 7, wherein the third elastic bars are also housed within a respective hollow housing defining a longitudinal axis parallel to the axis of the respective third elastic bar contained therein;

wherein the two ends of each third elastic bar are fixed and pretensioned within corresponding ends of the respective hollow housing;

wherein the two ends of each hollow housing are removably fixed to the support fixed frame;

and wherein a central part of each hollow housing has at least one through-hole, transverse to the longitudinal axis of the hollow housing, at the central portion of the respective third elastic bar to allow either constraining or releasing said central portion to or from the oscillating structure.

13. The oscillating table according to claim 1, wherein the two ends of each hollow housing of the first and second elastic bars are removably fixed to the support fixed frame at predefined areas provided on the support fixed frame, preferably at predetermined holes corresponding to different inclinations of the first and second elastic bars.

14. A method of assembling an oscillating table according to claim 1, wherein it is provided that each first elastic bar and each second elastic bar are housed within a respective hollow housing, the two ends of each first elastic bar and each second elastic bar being fixed and pretensioned within corresponding ends of the respective hollow housing;

the method comprising the following steps:

a) inserting the oscillating structure at least partially into the fixed frame;

b) inserting the central portion of each first elastic bar and each second elastic bar onto the oscillating structure by means of the through-hole of the central part of the respective hollow housing;

c) adjusting the first acute angle of inclination of the first elastic bars and the second acute angle of inclination of the second elastic bars;

d) removably fixing the two ends of each hollow housing to the fixed frame;

e) fixing the central portion of each first elastic bar and each second elastic bar to the oscillating structure.

15. The method according to claim 14, wherein after step e) there is provided the insertion of the ingot mold, provided with the crystallizer, into the oscillating structure.

16. The method according to claim 14, wherein steps d) and e) can be inverted.

17. The method according to claim 14, wherein, in step b) the central portion of each first elastic bar and each second elastic bar is inserted onto the oscillating structure at a respective fixing device provided on said oscillating structure.

18. The method according to claim 17, wherein in step b) the central portion of each first elastic bar and each second elastic bar is fitted in a first part of a respective fixing device, said first part being proximal and fixed to the oscillating structure so as to rotate about an axis thereof transverse to the oscillating structure;

in step c) the first acute angle and the second acute angle are adjusted by rotating the respective first part about the axis thereof;

in step e) the fixing of the respective central portion to the oscillating structure occurs by applying a second part of the locking device onto the first part;

or wherein in step b) the central portion of each first elastic bar and each second elastic bar is inserted into a groove of a first part of a respective fixing device, said first part being proximal and fixed integrally to the oscillating structure;

in step c) the first acute angle and the second acute angle are adjusted by fixing the respective central portion inside the corresponding groove, by eliminating a yoke between said central portion and said groove;

in step e) the fixing of the respective central portion to the oscillating structure occurs by applying a second part of the locking device onto the first part.

19. The method according to claim 14, wherein there is further provided inserting a central portion of two third elastic bars onto the oscillating structure, arranging them parallel to each other and transverse to the first elastic bars and to the second elastic bars, at a third side of the fixed frame which is transverse to said first side and said second side;

fixing both ends of said third elastic bars to the fixed frame;

fixing the central portion of each third elastic bar to the oscillating structure;

and, preferably, wherein there is further provided inserting a central portion of at least one fourth elastic bar onto the oscillating structure, arranging it parallel to the third elastic bars at a fourth side of the fixed frame, opposite to said third side;

fixing both ends of said fourth elastic bar to the fixed frame;

fixing the central portion of said fourth elastic bar to the oscillating structure.

* * * * *